United States Patent [19]

Wing et al.

[11] 3,944,481

[45] Mar. 16, 1976

[54] CONVERSION OF CRUDE OIL FRACTIONS TO OLEFINS

[75] Inventors: Milton Silas Wing, Lake Jackson; Billy Duane Head, Angleton, both of Tex.

[73] Assignee: The Dow Chemical Company, Midland, Mich.

[22] Filed: Nov. 5, 1973

[21] Appl. No.: 413,106

[52] U.S. Cl. ..... 208/61; 260/683 R

[51] Int. Cl.[2] ..... C10G 37/04; C07C 3/08

[58] Field of Search ..... 208/61, 58, 111, 112; 260/683 R

[56] References Cited

UNITED STATES PATENTS

| | | | |
|---|---|---|---|
| 2,910,428 | 10/1959 | Thomas et al. | 260/683 R |
| 3,268,437 | 8/1966 | Beuther et al. | 208/61 |
| 3,373,220 | 3/1968 | Hepp | 208/61 |
| 3,399,132 | 8/1968 | Mulaskey | 208/111 |
| 3,498,906 | 3/1970 | Bogart et al. | 260/683 R |
| 3,726,789 | 4/1973 | Kovach | 208/67 |
| 3,781,195 | 12/1973 | Davis et al. | 260/683 R |
| 3,839,484 | 10/1974 | Zimmerman et al. | 208/61 |
| 3,843,510 | 10/1974 | Morrison et al. | 208/111 |

*Primary Examiner*—Herbert Levine
*Attorney, Agent, or Firm*—Benjamin G. Colley

[57] ABSTRACT

A catalytic process for hydrocracking crude oil fractions into a $C_2$–$C_5$ alkane mixture having a normal paraffin to isoparaffin molar ratio greater than about 3:1 and thermally cracking this mixture to recover ethylene and propylene.

The hydrocracking catalysts used are made from a Group VIII metal, a Group VI B metal or mixtures thereof, with a halogen supported on a silica-alumina support or a natural or synthetic faujasite. The catalysts must be sulfided prior to or during use.

9 Claims, No Drawings

CONVERSION OF CRUDE OIL FRACTIONS TO OLEFINS

BACKGROUND OF THE INVENTION

The present invention relates to an improved process for converting crude oil fractions into an olefin product by hydrocracking the crude oil fractions to $C_2$–$C_5$ paraffins and thermally cracking these to a $C_2$–$C_3$ olefin mixture.

It is known from U.S. Pat. No. 3,598,724 that $C_3$–$C_4$ paraffins can be produced from hydrocarbons boiling in the range from 100°F. to 550°F. by hydrocracking over a catalyst comprising mordenite mixed with a nickel/tin catalyst supported on an amorphous inorganic oxide.

Similar patents such as U.S. Pat. No. 3,385,782 suggest the hydrocracking of high boiling hydrocarbon fractions into $C_1$–$C_4$ paraffins.

These prior art process, as well as U.S. Pat. No. 3,718,575, are primarily concerned with the production of LPG or liquified petroleum gas ($C_3$–$C_4$) useful as fuels and thus were interested mainly in producing higher yields of $C_3$–$C_4$ than the $C_1$–$C_2$ yields.

SUMMARY OF THE INVENTION

It now has been discovered that by using a highly active catalyst, larger amounts of hydrogen and higher temperatures, it is possible to hydrocrack a crude oil fraction boiling in the range from 200° to 1000°F. with substantially complete conversion into a $C_2$–$C_5$ product having a normal paraffin to isoparaffin molar ratio ranging from about 3:1 to about 6:1 and subsequently thermally crack this $C_2$–$C_5$ product into a $C_2$–$C_3$ olefin mixture.

The advantage in having a high normal paraffin ratio in the $C_2$–$C_5$ product is that this product can be used as a replacement for L.P.G. as a feedstock to existing ethylene production facilities without extensive and/or expensive modifications thereof.

A further advantage of the present invention is that whereas it is known to thermally crack gas oils to olefins in yields of 30–35 pounds per 100 pounds of feed, by using the present two-step invention it is possible to obtain yields of 50–60 pounds per 100 pounds of feed.

In general the present invention comprises a process for the production of ethylene and propylene as coproducts which comprises:

A. hydrocracking a crude oil fraction boiling in the range from 200° to 1000°F. by contacting a mixture of said fraction and hydrogen with a highly active sulfided hydrocracking catalyst under pressure greater than about 400 psig wherein
   1. the molar ratio of hydrogen to said fraction is in the range from about 4:1 to about 50:1;
   2. the temperature range is from about 300° to about 565°C.; and
   3. the residence time is from about one to about 180 seconds;
   4. the sulfided catalyst comprises a Group VIII metal, a Group VI B metal, or mixtures thereof, and a halogen, supported on a catalyst support of silica-alumina mixtures, or a natural or synthetic faujasite;
   5. conditions (1) – (3) are selected so as to achieve a normal paraffin to isoparaffin molar ratio greater than about 3:1 in the hydrocracked product;

B. separating the hydrocracked product of step A. to recover a $C_2$–$C_5$ alkane product, C. thermally cracking the $C_2$–$C_5$ product and D. recovering ethylene and propylene as coproducts.

Preferably, the crude oil fraction used is a gas oil fraction boiling in the range from 350°–800°F. and preferably the molar ratio of hydrogen to the gas oil fraction is in the range from about 10:1 to about 30:1; the temperature range is from about 450° to about 550°C.; and the residence time is from about 5 to about 100 seconds.

DESCRIPTION OF THE INVENTION

In general, the present invention involves the hydrocracking of hydrocarbon feedstocks boiling in the range from 200° to 1000°F. These include diesel fuel, light gas oil, heavy gas oil, lube oil, catalytic cycle oil, and coke oven oil.

The catalysts used in this invention are generally known from U.S. Pat. No. 3,268,437; U.S. Pat. No. 3,399,132; U.S. Pat. No. 3,617,485 and French Pat. No. 2,141,584. The disclosures of these patents are incorporated by reference herein. The catalysts used are further illustrated by preparations 1–3 hereinafter.

The operating conditions under which the above catalysts are used in this invention for hydrocracking are a temperature range from about 300° to about 565°C. and preferably about 450° to about 550°C., a residence time from 1 to 180 seconds and preferably 5–50 seconds, a range of hydrogen to hydrocarbon molar ratio of from 4:1 to 50:1 and preferably 10:1 to 30:1 and a pressure range from about 400 to 2000 psig and preferably 500–900 psig.

It is to be understood that the conditions selected are chosen in order to insure that the hydrocarbon feed is completely converted to produce $C_2$–$C_5$ alkanes with a yield of 91–95% with only a 2–4% yield of methane and 1–7% yield of $C_6$–$C_9$ alkanes and with a normal paraffin to isoparaffin molar ratio greater than about 3:1.

As is known in the prior art, the catalysts may be sulfided by adding organic or inorganic sulfur compounds to the feed material or the catalyst may be sulfided during their preparation as is shown in Preparation 3 hereinafter.

A related aspect of the invention as hereinbefore mentioned is that the hydrocracked product can be fed to a thermal cracker operating under a temperature range from about 800° to about 925°C.; a pressure range from about 10 to 30 psig; a residence time range from about 0.1 to 1.0 seconds and a steam/hydrocarbon ratio of about 0.1 to about 1.0 lb. steam/lb. hydrocarbon to produce an ethylene-propylene product.

The following examples are presented to further illustrate but not limit the invention.

Preparation 1 — Preparation of 6% Ni, 19% W, 2% F on $SiO_2$-$Al_2O_3$

The support for the catalyst was ⅛ inches extrudates composed of 25% $Al_2O_3$ and 75% $SiO_2$. 119.5 gm. of this support was dried for approximately 16 hours in an oven at 115°C.

A solution was prepared by dissolving 47.4 gm. of $Ni(NO_3)_2.6H_2O$ in 40 ml. deionized water and dissolving 44.4 gm. $(NH_4)_6W_7O_{24}.6H_2O$ in 40 ml. deionized water. The two solutions were mixed and the volume adjusted to 113 ml. with the addition of deionized water. This solution was poured slowly (while stirring) over the dried support.

The catalyst was dried for approximately 16 hours at 115°C. and was then calcined in a muffle furnace at 550°C. for 5 hours.

4 ml. of 48% hydrofluoric acid was diluted to 100 ml. with deionized water and the solution was poured slowly over the calcined catalyst until all of the solution was adsorbed. The catalyst was dried at 115°C. for 3 hours and calcined at 550°C. for 5 hours. Surface area of the catalyst was 162 $m^2$/gm.

Preparation 2 — Preparation of 6% Ni, 19% W, 2% F on Rare Earth Exchanged Y-Zeolite 239 gm. of Linde SK-500 catalyst (a Y-zeolite exchanged with 10% rare earth mixture) was dried for approximately 16 hours at 200°C. in a flowing stream of nitrogen.

94.7 gm. $Ni(NO_3)_2.6H_2O$ and 88.8 gm. $(NH_4)_6W_7O_{24}.6H_2O$ was dissolved in deionized water and the final volume of the solution was adjusted to 150 ml. by addition of deionized water. This solution was poured slowly over the zeolite. The mixture was stirred until all of the liquid was adsorbed. The catalyst was dried for 2 hours at 155°C. and then calcined at 500°C. for 2 hours.

8 ml. of 48% hydrofluoric acid was diluted to 100 ml. and was poured slowly over the calcined catalyst until all of the solution was adsorbed. The catalyst was dried at 115°C. for 2 hours and calcined at 500°C. for 2 hours. Surface area of the catalyst was 275 $m^2$/gm.

Preparation 3 — Catalyst sulfiding Procedure

The catalysts were loaded into a 1 inch stainless steel tube reactor and dried at 400°C. and atmospheric pressure using a nitrogen flow of 1 liter per minute. Catalyst temperature was reduced to 50°C. and the nitrogen flow stopped. The sulfiding gas mixture was passed over the catalyst at a gas hourly space velocity of 680. This gas mixture was 10% hydrogen sulfide and 90% hydrogen.

As the hydrogen sulfide reacted with the catalyst the temperature exothermed. After the exotherm passed through the bed the temperature was held at 50°C. for 30 minutes and then was slowly raised to 325°C. It was held at 325°C. for two hours. At this point the sulfiding of the catalyst was complete.

Example 1 — Conversion of Gas Oil to Ethylene and Propylene

An experiment was conducted in which a gas oil was hydrocracked and the products were passed through a thermal cracker to produce ethylene and propylene. The hydrocracker consisted of a 1 inch O.D. stainless steel tube reactor 12 inches long loaded with 100 ml. of the catalyst of Preparation 1. The catalyst was sulfided according to the sulfiding procedure of preparation 3. A gas oil having a boiling point range from 350° to 500°F. was preheated and passed over the catalyst at a rate of 0.84 m/min which corresponds to a liquid hourly space velocity (LHSV) of 0.5. Hydrogen was mixed with the gas oil prior to entering the preheater at a rate of 2.46 liters per minute. The reactor temperature was 550°C. at a pressure of 600 psig. The $H_2$/hydrocarbon molar ratio was 30/1. Hydrocarbon product from the hydrocracker reactor was composed of 4.0% $CH_4$, 5.9% $C_2H_6$, 35.9% $C_3H_8$, 18.4% normal butane, 16.0% isobutane, 5.8% normal pentane, 8.7% isopentanes, and 5.3% $C_6$–$C_9$ paraffins.

The entire product from the hydrocracker, including hydrogen was passed directly into a laboratory thermal cracker whose inlet temperature was 500°C. The residence time was 0.5 sec., pressure was 15 psig, and the outlet temperature was 890°C. From this overall process the yield of each component was as follows: $C_2H_6$ — 16.4%, $C_2H_4$ — 38.1%, $C_3H_8$ — 0.5%, $C_3H_6$ — 2.0% and the remainder methane and $C_4$+ paraffins.

Better yields are obtained if the hydrogen, methane, and the $C_6$–$C_9$ components are separated from the $C_2$–$C_5$ fraction. The $C_2$–$C_5$ fraction is then mixed with steam in a ratio of 0.3 lb. steam/lb. $C_2$–$C_5$ and injected into the thermal cracker.

Examples 2–4 — Effect of Temperature on the Molar Normal/Iso Paraffin Ratio and on the Percent $C_2$–$C_5$ in the Product from the Hydrocracker

| Example | Temp. °C. | Press. psig | Molar n/i | Wt.% in Product $CH_4$ | $C_2$–$C_5$ | $C_6$–$C_9$ |
|---|---|---|---|---|---|---|
| 2 | 400 | 600 | 0.87 | 0.36 | 66.8 | 32.7 |
| 3 | 450 | 600 | 1.49 | 0.72 | 77.1 | 22.2 |
| 4 | 500 | 600 | 5.37 | 3.20 | 89.2 | 7.6 |

All examples were over sulfided 6% Ni, 19% W, 2% F on a $SiO_2$-$Al_2O_3$ support at LHSV of 1.0, $H_2$/HC molar ratio of 30/1 and with a conversion of 100% following procedures of Example 1. The feedstock was 50% hexadecane and 50% 2,6,10,14-tetramethyl pentadecane.

These examples show that at lower temperatures the desired high molar ratio of normal to isoparaffins (n/i) is not achieved while at higher temperatures the production of methane begins to become excessive.

Examples 5–6 — Effect of Sulfur on Methane Formation

| Example | Temp. °C. | Press. psig | Molar n/i | Wt.% in Product $CH_4$ | $C_2$–$C_5$ | $C_6$–$C_9$ | Comments |
|---|---|---|---|---|---|---|---|
| 5 | 550 | 600 | — | 99.6 | 0.4 | 0 | unsulfided catalyst |
| 6 | 550 | 600 | 3.55 | 4.0 | 90.8 | 5.0 | sulfided catalyst (about 2.0% sulfur) |

Both examples were over 6% Ni, 19% W, 2% F on $SiO_2$-$Al_2O_3$ with and without sulfur at LHSV of 0.5, $H_2$/HC molar ratio 32/1, and with a conversion of 100% following the procedures of Example 1. The feedstock was a gas oil with a boiling point range of 350°–500°F., average molecular weight of 190, and 7 ppm sulfur.

These examples show that without a sulfided catalyst the feedstock converts almost totally into methane.

Examples 7–9 — Effect of High Temperature (Excessive $CH_4$ Formation

| Example | Temp. °C. | Press. psig | Molar n/i | Wt.% in Product $CH_4$ | $C_2$–$C_5$ | $C_6$–$C_9$ |
|---|---|---|---|---|---|---|
| 7 | 500 | 600 | 2.95 | 2.6 | 75.1 | 21.2 |
| 8 | 550 | 600 | 6.09 | 6.7 | 71.2 | 21.2 |

-continued

| Example | Temp. °C. | Press. psig | Molar n/i | Wt.% in Product $CH_4$ | $C_2$–$C_5$ | $C_6$–$C_9$ |
|---|---|---|---|---|---|---|
| 9 | 610 | 600 | 19.96 | 20.4 | 67.6 | 11.5 |

All examples were over sulfided 6% Ni, 19% W, 2% F on $SiO_2$-$Al_2O_3$ at LHSV of 1.0, $H_2$/HC molar ratio of 30/1, and with a conversion of 100% following the procedures of Example 1. The feedstock was a gas oil with a boiling point of 260°–680°F., average molecular weight 200, and 0.26 weight percent sulfur.

These examples show that at temperatures over about 565°C., excess amounts of undesired methane are obtained.

Examples 10 and 11 — Effect of Fluorine Addition to Catalyst on % $C_2$–$C_5$ in Hydrocracker Product

| Example | Temp. °C. | Press. psig | Molar n/i | Wt. % in Product $CH_4$ | $C_2$–$C_5$ | $C_6$–$C_9$ | Comments |
|---|---|---|---|---|---|---|---|
| 10 | 550 | 600 | 3.10 | 4.3 | 83.8 | 11.3 | No flourine |
| 11 | 550 | 600 | 3.55 | 4.0 | 90.8 | 5.0 | 2% fluorine |

Both examples were over sulfided catalysts containing 6% Ni, 19% W, on a $SiO_2$-$Al_2O_3$ support with and without 2% fluorine at LHSV of 0.5, $H_2$/HC molar ratio 32/1, and with a conversion of 100% following the procedures of Example 1. The feedstock was a gas oil with a boiling point range of 350°–500°F., average molecular weight of 190, and 7 ppm sulfur.

These examples show a more acidic catalyst increases the yield of the desired $C_2$–$C_5$ product and decreases the $C_6$–$C_8$ component. Similar results are obtained with chlorine, bromine and iodine.

Example 12 — Conversion of Gas Oil to $C_2$–$C_5$ Paraffins

An experiment was conducted in which a gas oil was hydrocracked to produce a paraffinic product in the $C_2$–$C_5$ range. The hydrocracker consisted of a 1 inch O. D. tube reactor 12 inches long loaded with 200 ml. of the catalyst of Preparation 2. The catalyst was sulfided according to the sulfiding procedure of Preparation 3. Gas oil having a boiling point range of 290° to 685°F., an average molecular weight of 220, and a sulfur content of 0.18 wt.% was preheated and passed over the catalyst at a rate of 1.68 ml/min. which corresponds to a liquid hourly space velocity of 0.5. Hydrogen was mixed with the gas oil, prior to entering the preheater, at a rate of 4.74 liters/min. The reactor temperature was 475°C. at a pressure of 600 psig. The $H_2$/hydrocarbon molar ratio was 28/1. The hydrocarbon product from the hydrocracker reactor was composed of 3.1% $CH_4$, 7.7% $C_2H_6$, 40.3% $C_3H_8$, 17.7% n-$C_4H_{10}$, 15.4% i-$C_4H_{10}$, 4.1% n-$C_5H_{12}$, 5.9% i-$C_5H_{12}$ and 5.8% $C_6$–$C_9$ hydrocarbons. The conversion was 100%.

The above hydrocarbon product is then thermally cracked as in Example 1 to produce an ethylene-propylene product.

We claim:

1. A process for the production of an ethylene-propylene product which comprises:

A. hydrocracking a crude oil fraction boiling in the range from 200° to 1000°F. by contacting a mixture of said fraction and hydrogen with a highly active sulfided hydrocracking catalyst under a pressure greater than about 400 psig wherein 1. the molar ratio of hydrogen to said fraction is in the range from about 4:1 to about 50:1;
2. the temperature range is from about 300° to about 565°C.; and
3. the residence time is from about one to about 180 seconds;
4. the catalyst comprises of Group VIII metal, a Group VI B metal, or mixtures thereof and a halogen supported on a catalyst support of silica-alumina mixtures, or a natural or synthetic faujasite;
5. conditions (1) – (3) are selected so as to produce a $C_2$ – $C_5$ product in a yield of 91–95% and to achieve a normal paraffin to isoparaffin molar ratio greater than about 3:1 in the $C_2$ – $C_5$ portion of the hydrocracked product;

B. separating the hydrocracked product of step (A) to recover a $C_2$ – $C_5$ alkane product;

C. thermally cracking the $C_2$ – $C_5$ product and

D. recovering ethylene and propylene as co-products.

2. The method of claim 1 wherein the crude oil fraction is a gas oil boiling in the range from 350°–800°F.

3. The method of claim 2 wherein 1. the molar ratio of hydrogen to said fraction is in the range from about 10:1 to about 30:1;
2. the temperature range is from about 450° to about 550°C.; and
3. the residence time is from about 5 to about 50 seconds.

4. In a process for the production of an ethylene-propylene product wherein a crude oil fraction boiling in the range from 200° to 1000°F. is hydrocracked with a highly active sulfided hydrocracking catalyst under a pressure greater than about 400 psig and the hydrocracked product is thermally cracked to yield an ethylene-propylene product, the improvement which comprises contacting the crude oil fraction with hydrogen in a molar ratio of hydrogen to said fraction in the range from about 4:1 to 50:1 at a temperature range from about 300° to about 565°C. with a residence time ranging from about 1 to about 180 seconds so as to produce a $C_2$ – $C_5$ product in a yield of 91–95% and to achieve a normal paraffin to isoparaffin molar ratio greater than about 3:1 in the $C_2$ – $C_5$ portion of the hydrocracked product.

5. The process of claim 4 wherein the crude oil fraction is a gas oil boiling in the range from 350° to 800°F.

6. The process of claim 5 wherein the molar ratio of hydrogen to said gas oil is in the range from about 10:1 to about 30:1, the temperature range is from about 450° to about 550°C. and the residence time is from about 5 to about 50 seconds.

7. A process for the production of an ethylene-propylene product which comprises:

A. hydrocracking a crude oil fraction boiling in the range from 200° to 1000°F by contacting a mixture of said fraction and hydrogen with a highly active sulfided hydrocracking catalyst under a pressure greater than about 400 psig wherein 1. the molar ratio of hydrogen to said fraction is in the range from about 4:1 to about 50:1;
2. the temperature range is from about 300° to about 565°C.; and
3. the residence time is from about one to about 180 seconds;
4. the catalyst comprises a Group VIII metal, a Group VI B metal, or mixtures thereof supported on a catalyst support of silica-alumina mixtures, or a natural or synthetic faujasite;
5. conditions (1) – (3) are selected so as to produce a $C_2 - C_5$ product in a yield of 91–95% and to achieve a normal paraffin to isoparaffin molar ratio greater than about 3:1 in the $C_2 - C_5$ portion of the hydrocracked product;

B. separating the hydrocracked product of step (A) to recover a $C_2 - C_5$ alkane product;

C. thermally cracking the $C_2 - C_5$ product and

D. recovering ethylene and propylene as co-products.

8. The method of claim 7 wherein the crude oil fraction is a gas oil boiling in the range from 350°–800°F.

9. The method of claim 8 wherein 1. the molar ratio of hydrogen to said fraction is in the range from about 10:1 to about 30:1;
2. the temperature range is from about 450° to about 550°C.; and
3. the residence time is from about 5 to about 50 seconds.

* * * * *